US005255907A

United States Patent [19]

Orlandini

[11] Patent Number: 5,255,907

[45] Date of Patent: Oct. 26, 1993

[54] DEVICE FOR CONVEYING PRINTED SHEETS IN AN INSTALLATION FOR CHECKING THE QUALITY OF PAPER MONEY

[75] Inventor: Dante Orlandini, Milan, Italy

[73] Assignee: de la Rue Giori S.A., Lausanne, Switzerland

[21] Appl. No.: 20,771

[22] Filed: Feb. 22, 1993

[30] Foreign Application Priority Data

Mar. 3, 1992 [CH] Switzerland ..... 661/92

[51] Int. Cl.[5] ..... B65H 5/12

[52] U.S. Cl. ..... 271/277; 271/82; 271/195; 271/196

[58] Field of Search ..... 271/277, 82, 195, 196

[56] References Cited

U.S. PATENT DOCUMENTS

| | | | |
|---|---|---|---|
| 2,657,052 | 10/1953 | Elliott . | |
| 4,259,695 | 3/1981 | Nakano | 271/277 X |
| 4,843,433 | 6/1989 | Minami | 271/277 X |
| 5,140,166 | 8/1992 | Gerlier . | |

FOREIGN PATENT DOCUMENTS

| | | |
|---|---|---|
| 2720674 | 5/1977 | Fed. Rep. of Germany . |
| 2908362 | 3/1979 | Fed. Rep. of Germany . |
| 3412181 | 1/1985 | Fed. Rep. of Germany . |
| 9115032 | 2/1992 | Fed. Rep. of Germany . |
| 760051 | 8/1932 | France . |
| 491981 | 10/1936 | United Kingdom . |
| 2055087 | 2/1981 | United Kingdom . |

*Primary Examiner*—Richard A. Schacher

*Attorney, Agent, or Firm*—Kane, Dalsimer, Sullivan, Kurucz, Levy, Eisele & Richard

[57] ABSTRACT

The device comprises a conveying cylinder (1) for the sheets (3) to be checked, which is provided with a bar of sheet-clamps (2) and at least one detector (4). In proximity to the detector (4), there is provided a calibrating strip (6) mounted in a movable manner with respect to the surface of the cylinder (1) and linked to a mechanism (5) enabling it to be lifted intermittently when the clamps (2) pass below, and adjusting mechanism (12-15) for setting the distance from said strip to the cylinder in its operating position to a determined value.

9 Claims, 2 Drawing Sheets

DEVICE FOR CONVEYING PRINTED SHEETS IN AN INSTALLATION FOR CHECKING THE QUALITY OF PAPER MONEY

FIELD OF THE INVENTION

The present invention relates to a device for conveying printed sheets in an installation for checking the quality of paper money, particularly bank notes, comprising a cylinder and at least one detector placed near the periphery of the cylinder, said cylinder being equipped with at least one bar of clamps for grasping the front edge of the sheet to be conveyed.

PRIOR ART

Devices are already known for checking the quality of bank notes. For example Patent FR 1,489,113 describes a method and a device according to which non-cut sheets of notes are firstly checked visually in order to enable the operator to mark the faulty notes, exhibiting errors in color or stains. The sheets are then cut into notes which pass on a first cylinder in front of detectors checking the side of the note facing outward and reacting to the checking marks borne by the notes, as well as to the errors in the centering of the print. The notes are then transferred to a second cylinder where detectors check their other side. The faulty notes are automatically picked out of the conveyor chain and replaced by faultless notes. Finally, an automatic installation makes it possible to count the checked notes and to pack them in the form of wads.

With the latest developed techniques, the requirements for checking the quality of recently printed notes are increasing more and more. The detectors which pick up the details of register, of color, of ink variation, of faults such as stains, spoils, etc.. are becoming increasingly sophisticated which results in very strict requirements regarding the position of the sheets to be examined with respect to said detectors, the sheets having to be kept at a very precise distance from the detector, with a maximum tolerance of the order of ± 0.2 mm. The sheets to be examined which have been also printed in intaglio have very sizable deformations due to the striking force during the printing and their surface exhibits undulations which, added to the aerodynamic effects created by the speed of conveyance of the sheets of the order of 2.8 meters per second, produce conditions which are unacceptable for an accurate scanning, considering the precision of current detectors. It is therefore essential that this sheet hugs, at least when it passes under the detector, the surface of the cylinder without forming undulations.

SUMMARY OF THE INVENTION

The present invention proposes to build a conveyor device which guarantees that the sheet hugs the cylinder perfectly when it passes in front of the detector system, without any risk of damaging the print recently produced on the sheets.

For this purpose, the device according to the invention is defined by the defining clause of claim 1.

The advantage of this device is to enable the printed sheet to hug perfectly, under the action of the calibrating strip, the conveying cylinder for the whole time during which it passes in proximity to the detector, while avoiding a collision between the strip and the clamps when the latter draw level with said strip.

Preferred embodiments of the invention result from the dependent claims.

BRIEF DESCRIPTION OF THE DRAWINGS

The invention will be described, by way of non-limiting example, with reference to the attached drawing.

DESCRIPTION OF THE PREFERRED EMBODIMENT S

Figure 1:
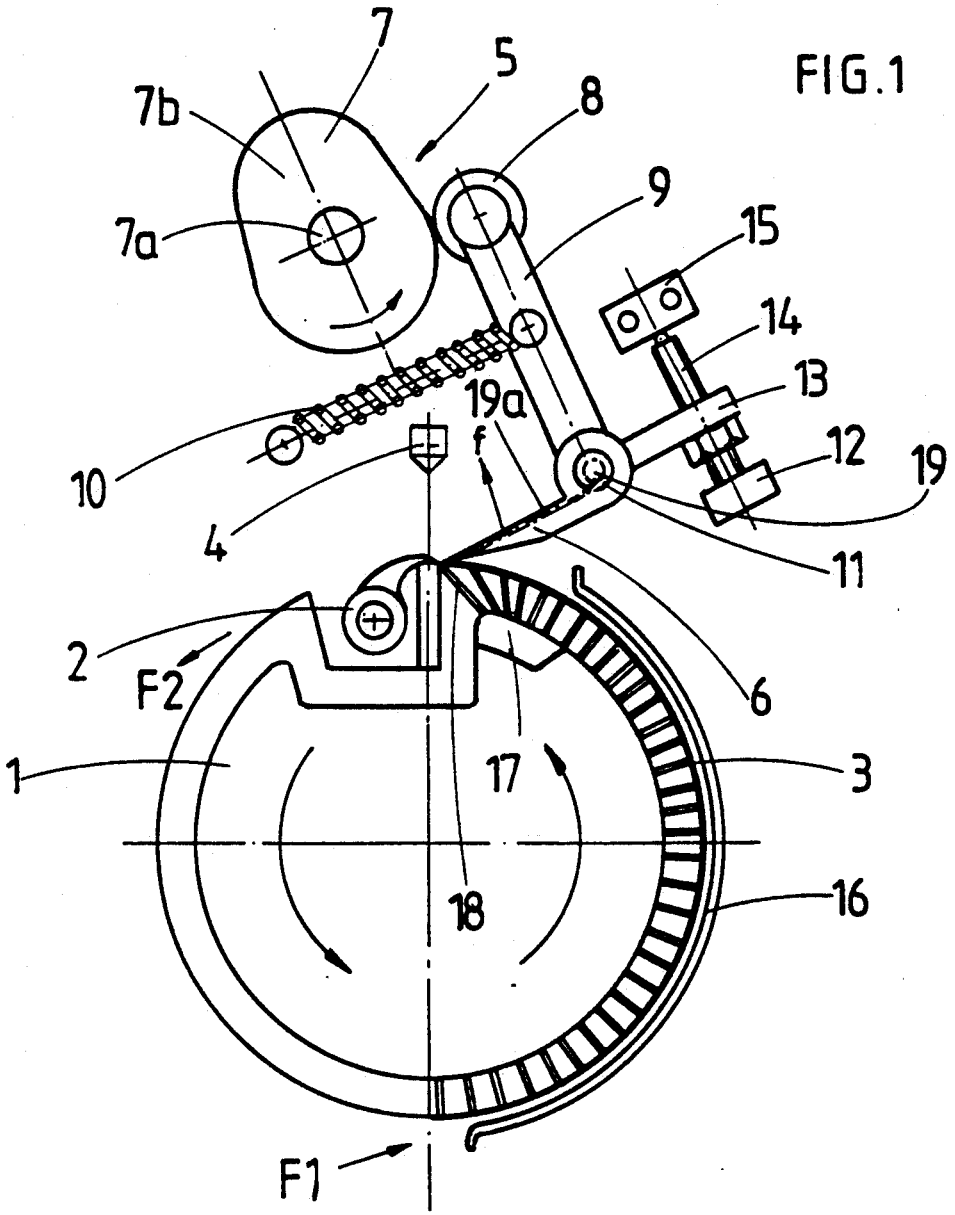
FIG. 1 shows a diagrammatical view of the device with a cylinder provided with a bar of sheet-clamps and of the mechanism enabling the sheet to hug the cylinder.

The conveying cylinder 1 depicted in FIG. 1 rotates in the direction of the curved arrows and is provided with a bar of clamps 2 which are intended to grip the front edge of a sheet 3 to be examined arriving at the lower part of the cylinder as shown by the arrow F1, in order to convey it below a detector 4 provided for inspecting the printing faults on the outer face of the sheet, for example, the back. The sheet 3 is then transferred, as shown by the arrow F2, on a second conveying cylinder, not shown, similar to the first cylinder, for inspecting the other face of the sheet, for example, the front. The conveying cylinder 1 is mounted on a central shaft, not shown, supported by bearings.

In proximity to the detector 4, there is provided a calibrating strip 6, made of metal, enabling the sheet 3 to hug the conveying cylinder 1. This strip 6 is fixed to a lever 9 itself mounted in an articulated fashion to a spindle 11 which is firmly attached to the frame. The lever 9 is linked to a mechanism 5 making it possible to lift the strip 6 of the cylinder 1 intermittently when the clamps 2 pass under said strip 6. This mechanism 5 includes a cam 7 which comprises a lobe **7*b* and is mounted on a shaft 7*a*, the rotation of which is synchronized with that of the conveying cylinder 1. A follower roller 8 mounted at the free end of the lever 9 is provided for bearing against the surface of the cam 7 by means of a return string 10** working in tension.

The distance between the end of the strip 6 and the surface of the cylinder 1 is adjusted by means of an adjusting screw 12 screwed in a tapped hole of an arm 13 which is itself fixed perpendicularly to the lever 9 in the opposite direction to the strip 6. The end 14 of the screw 12 bears in the operating position, under the action of the spring 10, against a stop-piece 15 fixed on the frame.

In order to allow the conveyed sheet 3 to be guided when the cylinder 1 rotates at high speed, an arc-shaped guide 16 is provided opposite a part of the periphery of the cylinder 1, near the calibratinq strip 6.

When the installation is started up, the distance between the calibrating strip 6 and the surface of the cylinder 1 is preadjusted as a function of the thickness of the paper. For this purpose, the screw 12 is manipulated until this distance corresponds to the requirements of the detector 4. In general, this distance corresponds approximately to the thickness of the paper, so that the strip 6 grazes the surface of the paper, without any pressure, in order to prevent it from damaging the print produced on the sheet 3. The operating position is therefore defined by the adjustment of the screw 12, the end 14 of which bears against the stop-piece 15; the allowable tolerance is generally of the order of approximately ± 0.2 mm.

The profile of the cam 7 and the synchronization of the mechanism are such that in the position of operation, that is to say when the sheet 3 passes by under the detector, the calibrating strip 6 is positioned, as described above, in a position in which it grazes the sheet, whereas when the bar of clamps 2 passes below the calibrating strip 6, the cam 7 with its lobe 7*b* tilts the lever 9 about the spindle 11, thereby stretching the spring 10, so that the strip 6 is lifted, for example by a few millimeters, in the direction of the arrow f, and the end 14 of the screw 12 moves off from the stop-piece 15. The height by which the strip 6 is lifted is adapted to allow the clamps to pass without damaging the strip. The strip 6 is therefore lifted for a duration and by a height which are defined by the shape of the lobe 7*b* of the cam 7 interacting with the follower roller 8, whereas the operating position of the strip 6 is solely defined by the adjustment of the screw 12, the end 14 of which bears, under the action of the spring 10, against the stop-piece 15, and not by the profile of the cam 7 in the portion excluding the lobe 7*b*. For this reason, the portion of the cam 7 excluding the lobe 7*b* does not have to have a concentricity which corresponds to the said tolerance, it is sufficient for this portion of the cam not to play a part in the operating position, since the follower roller 8 does not even have to touch this portion.

As soon as the clamps 2 have traveled past the zone of the strip 6, the roller 8 has passed the zone of the lobe 7*b* of the cam 7 and the lever 9 returns to its operating position under the action of the spring 10.

In order to improve further the adherence of the sheet to be examined 3 on the conveying cylinder 1, it is possible to provide, in addition, as shown in FIG. 1, a suction device formed by rows of holes 18 distributed on the surface of the cylinder and linked to a vacuum which acts only on a sector 17 situated in the zone where the detector 4 is located.

In addition, the strip 6 is preferably provided with a blown-air intake hole 19 connected to an internal channel 19*a* which emerges at the tip of the strip, in order to direct the air current against the paper and help in pressing the latter against the cylinder.

Figure 2:
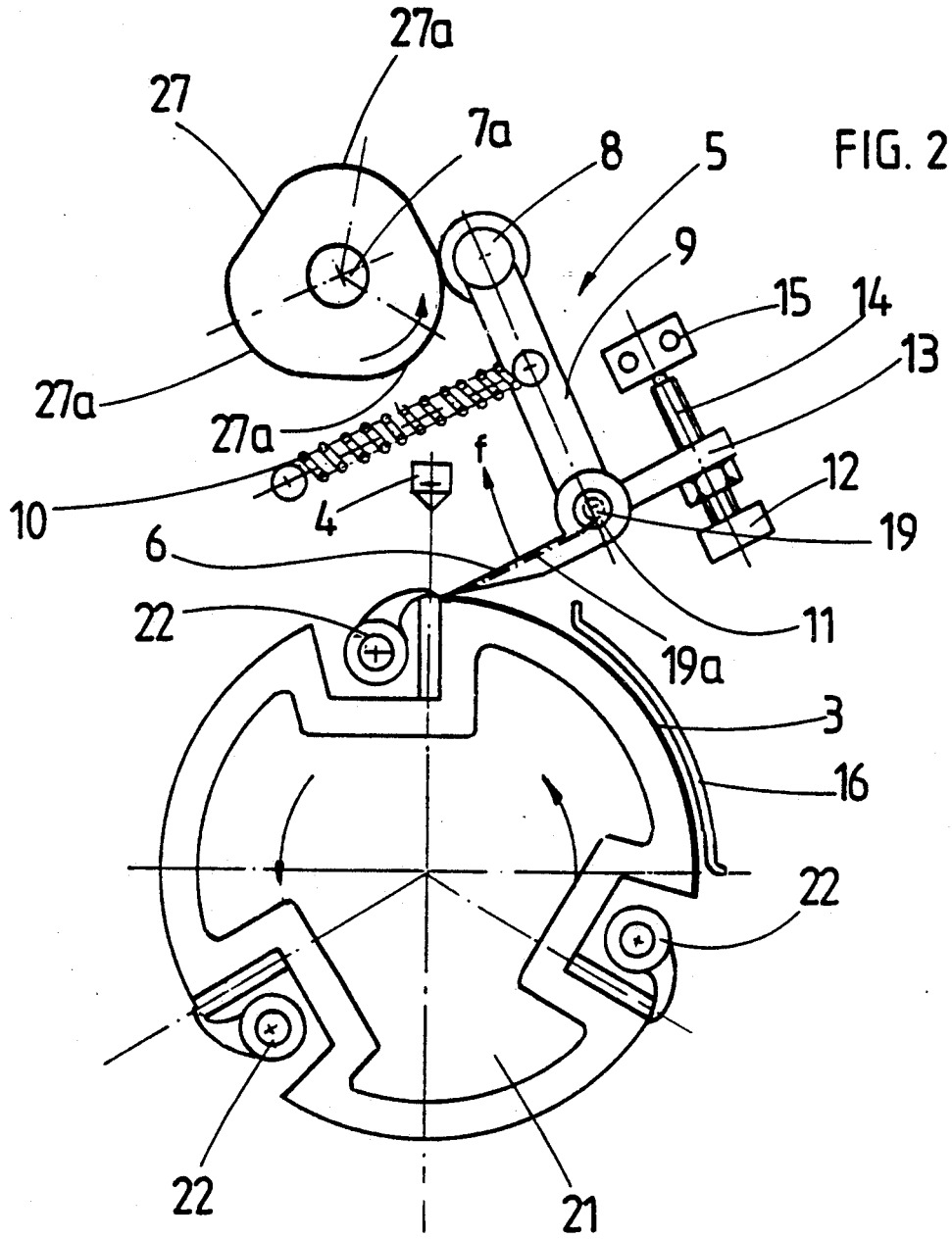
FIG. 2 shows the same device fitted to a cylinder with three bars of clamps.

FIG. 2 shows a second embodiment of the cylinder and of the mechanism for holding the sheet. In this case, the cylinder 21 is equipped with three bars of clamps 22, distributed in an equidistant manner over the periphery of the cylinder which comprises three sectors, each intended for supporting sheet. The mechanism 5 for holding the sheet is the same as in the first embodiment and comprises the same elements, except for the cam 27 which has a different shape adapted for lifting the strip 6 intermittently three times during a rotation of the conveying cylinder 21, that is to say when each bar of clamps 22 passes under the strip 6. For this purpose, the cam 27 is provided with three equal lobes 27*a* which cause the strip 6 to tilt.

The invention is not limited to the described embodiments and embodiment variants could be added without necessarily leaving the scope of the invention.

I claim:

1. A device for conveying printed sheets in an installation for checking the quality of paper money, particularly bank notes, comprising a cylinder (1; 21) and at least one detector (4) placed near the periphery of the cylinder, said cylinder being equipped with at least one bar of sheet-clamps (2; 22) for grasping the front edge of the sheet (3) to be conveyed, wherein, in proximity to said detector (4), there is provided a calibrating strip (6) mounted in a movable manner with respect to the surface of the cylinder (1; 21), means (12–15) for adjusting said strip (6) in order to set, in its operating position, the distance from this strip to the cylinder (1; 21) to a value determined so that the sheet (3) to be examined hugs said cylinder (1; 21), and a mechanism (5) for lifting said strip (6) intermittently when the clamps (2; 22) pass below the strip (6) in order to avoid a collision between the clamp and said strip.

2. The device as claimed in claim 1, wherein the calibrating strip (6) is fixed to the end of a lever (9) which is articulated on a spindle (11) and the other end of which is provided with a roller (8) interacting, under the action of return means (10) with a cam (7; 27), itself mounted on a shaft (7*a*) the rotation of which is synchronized with that of said cylinder (1; 21), wherein the means for adjusting the calibrating strip (6) consist of an adjusting screw (12) acting on said lever (9) and defining its operating position by bearing, in this operating position, under the action of said return means (10), against a fixed stop-piece (15), the configuration of the cam (7; 27) being such that, during a rotation of the cylinder (1; 21), the calibrating strip (6) is in the operating position, at a determined distance from said cylinder while the conveyed sheet (3) is opposite the detector (4), and that said strip is moved away from said cylinder when the clamps (2, 22) pass under this strip.

3. The device as claimed in claim 2,, wherein the screw (12) is screwed in an arm (13) itself fixed perpendicularly to the lever (9).

4. The device as claimed in claim 1, wherein there is provided, in front of the calibrating strip (6), an arc-shaped guide (16) opposite a part of the periphery of the cylinder (1; 21).

5. The device as claimed in claim 1, wherein the cylinder (1) is provided with a suction system and, for this purpose, comprises rows of holes (18) distributed on its surface and linked to a vacuum which acts only in a sector (17) situated in the zone where the detector (4) is located.

6. The device as claimed in claim 1, wherein the strip (6) is provided with a blown-air intake hole (19) connected to an internal channel (19*a*) emerging at the tip of the strip in order to direct the blown air against the paper.

7. The device as claimed in claim 1, wherein it is provided with a plurality of bars of sheet- clamps (22) and wherein the mechanism (5) is provided for lifting the strip (6) as each bar of sheet-clamps passes below.

8. The device as claimed in claim 2, wherein said cam (27) has a number of lobes (27*a*) corresponding to the number of bars of clamps (22).

9. The device as claimed in claim 1, wherein the strip (6) is made of metal.

* * * * *